US005861571A

United States Patent [19]

Scheffee et al.

[11] Patent Number: 5,861,571

[45] Date of Patent: Jan. 19, 1999

[54] GAS-GENERATIVE COMPOSITION CONSISTING ESSENTIALLY OF AMMONIUM PERCHLORATE PLUS A CHLORINE SCAVENGER AND AN ORGANIC FUEL

[75] Inventors: Robert S. Scheffee, Lorton; Brian K. Wheatley, Marshall, both of Va.

[73] Assignee: Atlantic Research Corporation, Gainesville, Va.

[21] Appl. No.: 840,472

[22] Filed: Apr. 18, 1997

[51] Int. Cl.[6] ..... C06D 5/06; C06B 29/22

[52] U.S. Cl. ..... 102/288; 102/289; 102/290; 149/76

[58] Field of Search ..... 102/288, 289, 102/290; 149/76

[56] References Cited

U.S. PATENT DOCUMENTS

| | | | |
|---|---|---|---|
| 3,031,347 | 4/1962 | Philipson | 149/19.91 X |
| 3,613,597 | 10/1971 | Warren et al. | 149/2 |
| 3,719,515 | 3/1973 | Degginger | 117/3 |
| 3,739,574 | 6/1973 | Godfrey | 60/39.03 |
| 3,811,358 | 5/1974 | Morse | 86/20 R |
| 3,841,929 | 10/1974 | Craig | 149/17 |
| 4,606,967 | 8/1986 | Mosser | 428/220 |
| 4,725,534 | 2/1988 | Kagami et al. | 430/619 |
| 4,948,438 | 8/1990 | Patrick et al. | 149/38 |
| 5,167,876 | 12/1992 | Lem et al. | 252/602 |

*Primary Examiner*—Peter A. Nelson

*Attorney, Agent, or Firm*—Sixbey, Friedman Leedom & Ferguson; Frank P. Presta; Joseph S. Presta

[57] ABSTRACT

This invention relates to gas-generative compositions consisting essentially of ammonium perchlorate with a chlorine scavenger, such as strontium nitrate, barium nitrate, potassium nitrate, or lithium carbonate, the combination being present in an amount of about 30 to about 95% by weight, up to about 5% by weight of a binder, up to about 5% by weight of a burning rate catalyst, together with an organic fuel, such as guanidine nitrate. The fuel is in an amount complementary to the combined weight of ammonium perchlorate, burning rate catalyst, chlorine scavenger, and binder, at an oxidation ratio of 0.90 to 0.98. The invention also includes the method of inflating an inflatable device by generating gas employing the noted composition and a gas generator in which the gas-generative composition is that of the present invention.

21 Claims, 2 Drawing Sheets

GAS-GENERATIVE COMPOSITION CONSISTING ESSENTIALLY OF AMMONIUM PERCHLORATE PLUS A CHLORINE SCAVENGER AND AN ORGANIC FUEL

TECHNICAL FIELD

The instant invention involves pyrotechnics that generate nontoxic combustion products, and that consist of an oxidizer composed of ammonium perchlorate and at least an equivalent weight of a non-halogenated compound of either strontium, barium, or any of the alkali metals, and at least a stoichiometric amount of an organic fuel. Although the composition may be employed to generate gas wherever it is required, such as for life rafts and emergency escape chutes on an airplane, it is primarily utilized to inflate an air bag used as an occupant restraint in a vehicle.

BACKGROUND ART

Air bags in vehicles are now commonplace to ensure the safety of the occupants in said vehicles. Nonetheless, formulations for generating suitable gases in said air bags are constantly being developed and evaluated with respect to factors such as toxicity, temperature of the gas generated, and the amount of particulates dispersed in the generated gas. Since smoke or gas with a smoke-like appearance may cause the occupants of a vehicle to suspect the possibility of a fire, components that produce visible particulates must be avoided, because of psychological reasons, as well as the possibility of any adverse physical problems. The composition of the invention disclosed herein is especially characterized by its reduced particulates.

In U.S. Pat. No. 3,031,347, slow burning solid composite propellants are disclosed for use in rocket or jet propulsion motors which include ammonium perchlorate and guanidine nitrate.

In U.S. Pat. No. 3,739,574, a gas generator is disclosed which may employ propellent mixtures for solid propellant motors including ammonium perchlorate and guanidine nitrate.

U.S. Pat. No. 4,948,438 concerns intermolecular complex explosives. The explosive compositions include ammonium nitrate and methyl nitro-guanidine with compounds such as ammonium perchlorate, potassium nitrate and guanidine nitrate being used as melting point depressants.

In recently issued U.S. Pat. No. 5,538,567, a gas generative propellent mix is disclosed consisting of from about 55% to about 75% by weight guanidine nitrate and from about 25% to about 45% by weight of an oxidizer selected from potassium and ammonium perchlorates. The composition also contains from about 0.5 to about 5.0% by weight of a flow enhancer and up to about 5% by weight of a binder.

DISCLOSURE OF THE INVENTION

It is a first object of the present invention to provide a gas-generative composition which has utility in inflating devices, particularly occupant restraint devices.

Another object of the present invention is to provide a method of generating a gas employing the inventive gas-generative composition and a gas generator.

Yet another object of the invention is to provide a gas-generative composition which results in a nontoxic, and reduced particulate formulation and one that is essentially smoke-free.

Other objects and advantages of the present invention will be apparent as a description thereof proceeds.

In satisfaction of the foregoing objects and advantages, one aspect of the present invention includes a gas-generative composition comprising essentially three components. A first component is ammonium perchlorate which functions as an oxidizer. A second component is a chlorine scavenger, which is in an amount so that the scavenger theoretically combines with the chlorine in the ammonium perchlorate. The chlorine scavenger is preferably a non-halogenated compound of either strontium, barium or an alkali metal, i.e., lithium, sodium or potassium. The amount of ammonium perchlorate and chlorine scavenger can be related in terms of an acceptable molar ratio of the chlorine scavenger to the ammonium perchlorate. For strontium or barium, the minimum acceptable molar ratio is 0.5. For the alkali metals, the molar ratio is unity. However, higher values can be used to ensure that the chlorine is totally scavenged.

The third component is an organic fuel for complete combustion. Complete combustion includes carbon to carbon dioxide, hydrogen to water and a metal of a metal-containing fuel to its metal oxide. The preferred amount of fuel is slightly in excess of the amount needed for complete combustion so that nitrogen oxide in the combustion product is minimized. Any resulting small amounts of hydrocarbon and carbon monoxide are in nontoxic and nonflammable amounts. The excess fuel is measured in terms of an oxidation or oxygen to fuel ratio defined as the molar ratio for oxygen in a mixture divided by the oxygen required to burn carbon to carbon dioxide, hydrogen to water and a metallic fuel to its major oxide. The metallic fuel is the surplus metal remaining after the chlorine ions are scavenged. Preferably, the oxygen ratio is less than 1 and, more preferably, between about 0.90 and 0.98.

Preferred chlorine scavengers are potassium nitrate, lithium carbonate, strontium nitrate and barium nitrate. A preferred fuel is guanidine nitrate or nitroguanidine.

The ammonium perchlorate and chlorine scavenger amounts can range from 30–95% of the total weight of the composition with the organic fuel comprising the balance. The composition can also include a catalyst such as an iron oxide and a polymeric binder.

The invention also includes the method of generating a gas by employing the gas-generative composition of the present invention, optionally with suitable other gas generators, for the production of nontoxic, nonflammable, odor-free gas. The method is preferably carried out in a conventional air bag inflator. The formulation is utilized either as a granular mix or as a pressed charge.

BEST MODE FOR CARRYING OUT THE INVENTION

Figure 1:
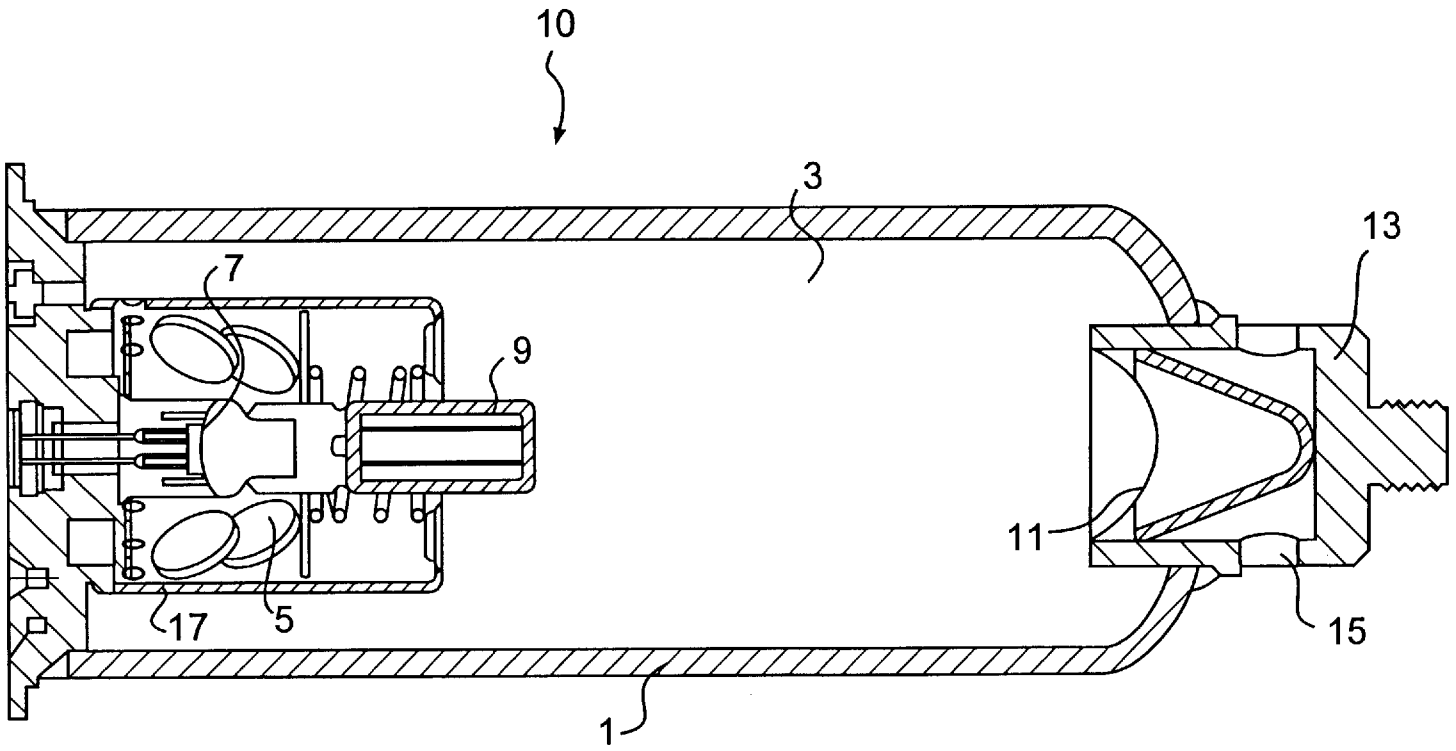
FIG. 1 is a conventional hybrid inflator for a vehicle air bag that may be used to practice the instant invention.

FIG. 1 depicts, in cross sectional view, a hybrid conventional passenger-side inflator (10) for an automobile, comprising a pressure tank (1) charged with an inert gas (3) and a generant container charged with a pyrotechnic of the gas-generative composition (5) of the instant invention. In practice, the initiator (7) ignites in response to a sensor (not shown) that senses rapid deceleration indicative of a collision. The initiator gives off hot gases that ignite the ignition charge (9) which causes the main generant charge (5) to combust, generating an inflation gas mixture consisting of combustion products and the inert gas. When the pressure in said gas mixture increases to a certain point, the seal disk (11) ruptures, permitting the gas mixture to exit the manifold (13) through the outlet ports (15) and inflate an air bag (not shown). The generant container (17) holds the main generant charge (5). All the charges in the inflation gas mixture are enclosed in the pressure tank (1).

Figure 2:
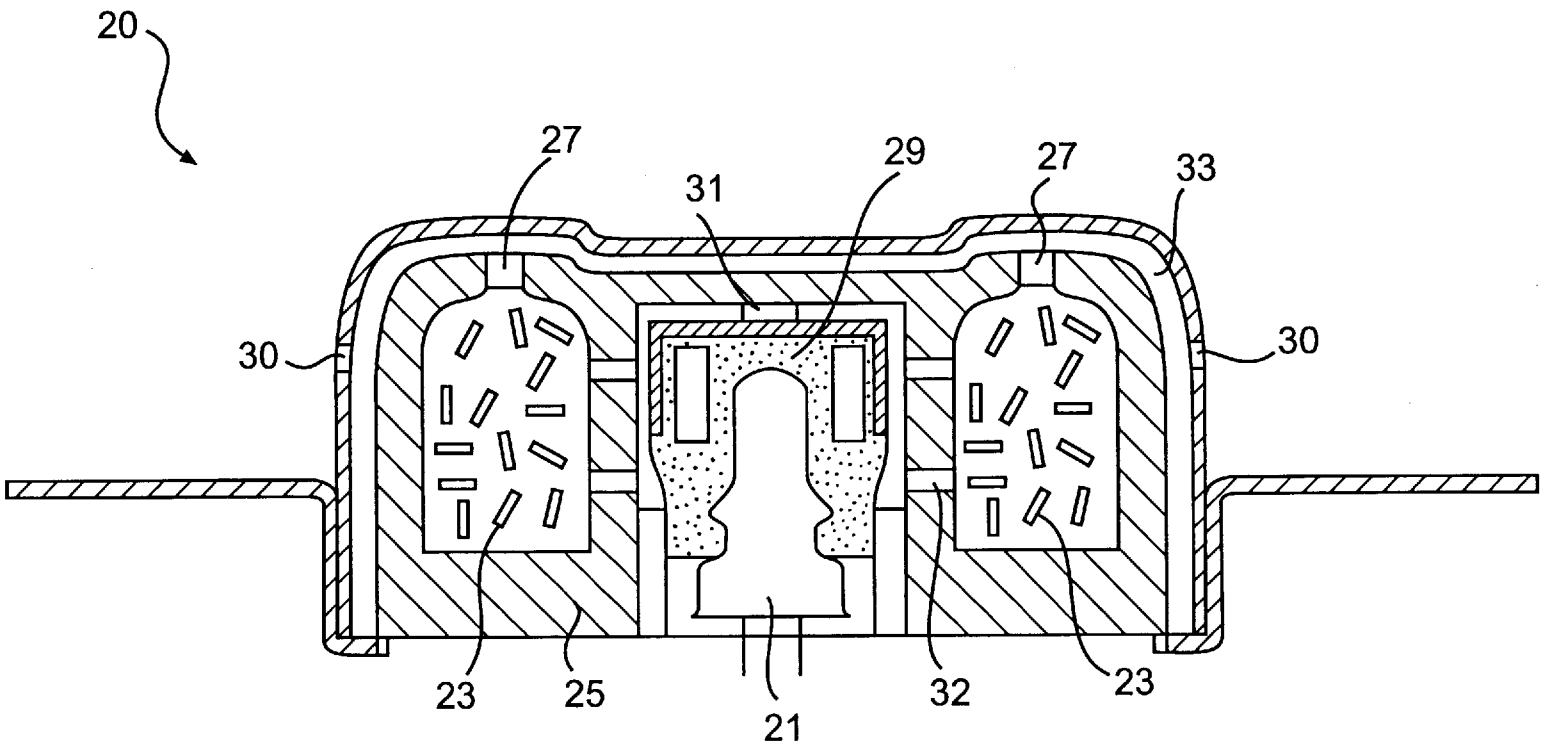
FIG. 2 is a conventional pyrotechnic inflator for a vehicle air bag that may be used to practice the instant invention.

FIG. 2 is a drawing of a pyrotechnic generator (20) in which the instant invention may be employed. Since no part of the inflator is reserved for storing inert gas, the device is smaller than its counterpart hybrid inflator. In this figure, there is an initiator (21) that will combust in response to a signal from a sensor (not shown), that generates said signal as a result of a change in conditions, e.g., a sudden deceleration of a vehicle (indicative of a crash), in which the inflator is installed. The initiator (21) gives off hot gases and particles that ignite an ignition charge (29).

The combustion products of the ignition charge (29) flow radially through a plurality of orifices (32) into the combustion chamber (25) igniting the main generant charge (23), whose combustion products comprise the inflation gas mixture. The mixture exits the combustion chamber (25) axially through the exit ports (27), flows through the manifold (33), and exits radially through a plurality of orifices (30). In the absence of initiator activation, but in the presence of a high-temperature environment, such as a burning automobile, then to insure that the ignition charge (29) will be ignited well below its autoignition temperature ($T_{ig}$) and well below that temperature where the materials of construction of the hardware begin to weaken, an autoignition propellant (AIP) (31) having a suitably low $T_{ig}$ is used to ignite the ignition charge (29), which then ignites the main generant charge (23). The inflators shown in FIGS. 1 and 2 are merely exemplary and the inventive gas-generative composition has utility on all types of devices and/or application where gas-generation is needed.

The gas-generative composition of the instant invention contains (1) ammonium perchlorate (AP), (2) a chlorine scavenger consisting of at least an equivalent weight of a non-halogenated compound of either strontium (Sr), barium (Ba), or an alkali metal (Li, Na, or K), and (3) at least a stoichiometric amount of an organic fuel. Equivalent weight is defined as the amount of scavenger theoretically required to combine with the chlorine in AP, based on valence. Thus, the theoretically minimum acceptable molar ratio of either Sr or Ba to AP is 0.5, and of an alkali metal to AP is unity. In practice, slightly higher values are usually employed to ensure that the chlorine is totally scavenged.

AP is the most industrially important oxidizer in the solid propellant industry, the state of the art of using AP in propellants being as advanced as that of any other ingredient. For example, a great deal is known about the effects of particle size and catalysts on ballistics, and for this reason it is a desirable oxidizer in gas generator propellants. However, its combustion products contain hydrogen chloride (HCl), which is both toxic and corrosive, and can also contain toxic amounts of nitrogen oxides (NOx). Both can be removed by judicious choice of propellant ingredients and propellant stoichiometry.

HCl can be scavenged from the combustion products if the AP is burnt with at least an equivalent amount of a non-halogenated compound of either strontium, barium, or an alkali metal. This results in the formation of the nontoxic and noncorrosive metal chlorides (i.e. $SrCl_2$, $BaCl_2$, LiCl, NaCl, or KCl), which can all be condensed and removed inside the inflator. Strontium and barium compounds of interest are the nitrates, carbonates, oxides, and hydroxides. The most interesting alkali metal compounds are the nitrates and carbonates of lithium, sodium, and potassium. The preferred amount of the scavenger compound is usually in excess of that needed to react with the chlorine in AP, in order to ensure complete removal of hydrogen chloride. Strontium, barium, and the alkali metal compounds are preferred because of the superior thermochemical stability of their chlorides in hot combustion products. The lower molecular weight alkaline earth compounds are not of interest because neither $CaCl_2$ nor $MgCl_2$ are stable at these conditions (beryllium compounds are not of interest because of their toxicity). Similarly, better known chlorine "getters" such as zinc and copper do not form stable chlorides at these conditions.

Although inorganic fuels are acceptable if they and their combustion products are nontoxic, their combustion products are condensed species. More preferred fuels are organic compounds, which burn to form gaseous combustion products ($CO_2$, $H_2O$, and $N_2$), which have obvious importance for gas generators. The preferred organic fuels have high oxygen and nitrogen contents, and correspondingly low chemical oxygen demand. This minimizes the amount of oxidizer needed for combustion, and thus the amount of ash (as the metal chloride) in the combustion products. Consequently, these kinds of fuels further increase the gas output of the propellant while reducing its smokiness, which are both important properties for bag inflation. Preferred fuels include oxygenated and/or nitrogen containing compounds such as guanidine, ethylene diamine, urea, tetrazole, urazole, uracil, melamine, cyanuric acid, and the like, and their oxygen-containing and/or nitrogen-containing derivatives (e.g. nitrates, nitramines, carbonates, amines, hydrazides, amides, and the like). Other preferred fuels include chemical foaming agents such as azodicarbonamide. The chlorides of these compounds are also acceptable, e.g. cyanuric chloride, if used with an equivalent weight of one of the scavengers.

In addition, binders such as polymeric compounds can be used as fuels. Polyvinyl alcohol, cellulosics, and other highly oxygenated resins such as polyethers and polyesters, as well as polyurethanes, polyacrylonitriles, and other nitrogen-containing resins are preferred binders. Chlorinated resins, such as polyvinyl chloride, are acceptable if used with an equivalent weight of one of the scavengers.

The preferred amount of fuel is slightly in excess of the amount needed for complete combustion to carbon dioxide and water (or the major metal oxide of inorganic fuels). This in turn results in compositions with a slightly fuel rich stoichiometry, which minimizes formation of nitrogen oxides in the combustion products, in spite of their thermochemical importance at combustion conditions. The resultant compositions necessarily generate small amounts of hydrogen and carbon monoxide in the combustion products, but in nonflammable and/or nontoxic concentrations.

The preferred content of AP plus chlorine scavenger is between about 30% to about 95% by weight, preferably, 30 to 60%, more preferably, 38 to 50%, depending on the scavenger and the oxygen demand of the fuel, with a complementary amount of fuel. The preferred oxidation ratio of the resultant mixtures is 0.90–0.98, defined as the molar ratio of oxygen in the mixture divided by the oxygen required to burn the carbon to carbon dioxide and the hydrogen to water, and a metallic fuel to its major oxide, if the metal is not used as a chlorine scavenger. At these oxidation ratios, the concentrations of $H_2$ and CO are nontoxic and nonflammable, and the concentrations of NOx are nontoxic.

The composition can also include an amount of a catalyst, up to 10% by weight, such as an iron oxide, a chromate, dichromate or the like. Since these catalysts are well known for use with ammonium perchlorate, a further description of the types or amounts is not necessary for understanding of the invention.

EXAMPLES

The compositions listed in Table 1 are exemplary of the present invention. They are all slightly fuel-rich, having oxidation ratios ($O_R$) of about 0.95, defined as the quotient of the oxygen available in the composition divided by the oxygen required for complete combustion. All of these compositions (designated as "COMP" and a number) were simply dry blends of the ingredients, pressed into pellets. Source of the compositions were analyzed by differential scanning calorimetry (DSC) for phase changes and ignition exotherms, and the burning rates of all the pellets were measured in a Crawford bomb.

First, the similarity of melting points of COMPs 449 and 450 indicate possible formation of a solid solution between AP and GN, since they are lower than the melting point/decomposition point of either. All of the compositions burned controllably and reproducibly. With guanidine nitrate, the highest burning rate was measured for COMP 450, which used $KNO_3$ as the scavenger. It also exhibited a surprisingly low pressure exponent. Red iron oxide increased its burning rate and pressure exponent, as expected. COMP 449, made with $Li_2CO_3$, was slower burning, but the addition of one part of red iron oxide (COMP 451) increased its rate at 4000 psi to the same as that of COMP 450. Without guanidine nitrate, the rates were measurably slower and the exponents higher. The addition of one part by weight of red iron oxide to 100 parts of COMP 546 did not significantly change either the rate or the exponent.

In addition to DSC and burning rate measurements, the pellets were exposed to a standard stability test consisting of exposure to 400 temperature cycles between −40 and ±107°. With guanidine nitrate, dimensional and crush strength changed respectively by +4.8 and −76% with lithium carbonate (COMP 449) and by +5.6 and −28% with potassium carbonate (COMP 450).

TABLE 1

| Parameter/Comp ID | 449 | 227 | 451 | 450 | 452 | 545 | 546 |
|---|---|---|---|---|---|---|---|
| Composition, WT % | | | | | | | |
| Guanidine Nitrate | 54.0 | 38.0 | 53.5 | 62.0 | 62.0 | | |
| Ammonium Perchlorate | 34.5 | 43.0 | 34.1 | 20.1 | 20.1 | 42.25 | 63.65 |
| Lithium Carbonate | 11.5 | 14.0 | 11.4 | | | | 20.1 |
| Postassium Nitrate | | | | 17.9 | 17.9 | 36.75 | |
| Cellulose Acetate Butyrate | | 5.0 | | | | 21.0 | 16.25 |
| Red Iron Oxide | | | 1.0 | | 1.0 | | |
| Melting Endotherm, °C. | 159 | | | 162 | | | |
| Ignition Exotherm, °C. | | | | | | | |
| Onset | 303 | | | 292 | | | |
| Peak | 354 | | | 349 | | | |
| Burning Rate, IN/SEC | | | | | | | |
| @ 2000 PSI | 0.32 | 0.19 | 0.39 | 0.52 | 0.58 | 0.28 | 0.25 |
| @ 4000 PSI | 0.52 | 0.37 | 0.64 | 0.63 | 0.74 | 0.59 | 0.46 |
| Pressure Exponent of Burning Rate | 0.70 | 0.94 | 0.71 | 0.28 | 0.35 | 0.99 | 0.86 |
| Thermal Cycling Stability: 400 Cycles @ - 40/+107° C. | | | | | | | |
| Diameter, IN | | | | | | | |
| Initial | 0.522 | 0.522 | | 0.522 | | 0.519 | 0.517 |
| Final | 0.547 | 0.530 | | 0.551 | | 0.519 | 0.517 |
| % Change | +4.8 | +1.5 | | +5.6 | | 0 | 0 |
| Crush Strength, PSI | | | | | | | |
| Initial | 4104 | 6569 | | 3198 | | 7429 | 8571 |
| Final | 996 | 6249 | | 2314 | | 5713 | 5861 |
| % Change | −76 | −4.9 | | −28 | | −23 | −32 |

However, these values were improved by use for a binder. Thus, when COMP 449 was modified by addition of 5% by weight of cellulose acetate butyrate binder, (COMP 227) the initial crush strength was increased to 6569 psi, and the dimensional and crush strength changes were reduced to only 1.5 and 4.9%, respectively. Without guanidine nitrate, and with only cellulose acetate hydrate as a fuel, the pellets suffered no dimensional changes during thermal cycling, but did suffer measurable loss of strength (COMP 545 and 546). However, the initial values were so high because of the binding effect of the fuel, that the final values were acceptable. Although, these two propellants had very low burning rates and very high pressure exponents, the selection of the types and amounts of fuel and burning rate catalyst can be used to optimize ballistic and mechanical properties.

The present invention involves a composition for generating a nontoxic, low particulate, non-flammable, odorless and colorless gas, which may be used to inflate automotive air bags and similar inflatable devices. When adjusted to an oxidation ratio of unity, similar—compositions have been used to provide a carrier gas for chemical fire suppressants in fire extinguishment systems. It is a further object to provide a composition with improved cycling stability and ballistic properties. The instant invention involves compositions with improved thermal cycling stability over the range of −40 to +107° C. and having a decreased pressure exponent.

Additional objects and advantages of the present invention will become readily apparent to those skilled in this art from the following detailed description wherein only the preferred embodiments of the invention are shown and described, simply by way of illustration of the best mode contemplated for carrying out the invention. As will be realized, the invention is capable of other and different embodiments and its several details are capable of modifications of various obvious respect, all without departing from the invention. Accordingly, the drawings and description are to be regarded as illustrative in nature and not as restrictive.

We claim:

1. A gas-generative composition comprising:

a) an amount of ammonium perchlorate;

b) at least one chlorine scavenger in an amount sufficient to combine with chlorine present in the amount of ammonium perchlorate; and c) at least a stoichiometric amount of organic fuel for complete combustion.

2. The gas-generative composition of claim 1 wherein an amount of oxygen in the composition divided by an amount of oxygen required to convert carbon in the composition to carbon dioxide, hydrogen in the composition to water and surplus metal (metal remaining after all $Cl^-$ is scavenged) in the composition to the major oxide of the metal as an oxidizer to fuel ratio ranges between about 0.90 and 0.98.

3. The gas-generative composition of claim 1 wherein the amounts of ammonium perchlorate and the chlorine scavenger together range between about 30 to 95% by weight of the total composition.

4. The gas-generative composition of claim 1 wherein the composition includes an amount of a polymeric binder, the binder acting as part of the fuel.

5. The gas-generative composition of claim 1 wherein the composition includes an amount of catalyst.

6. The gas-generative composition of claim 1 wherein the at least one chlorine scavenger is selected from the group of a non-halogenated compound of lithium, sodium, potassium, strontium, barium and combinations thereof.

7. The gas-generative composition of claim 6 wherein the chlorine scavenger in one of lithium carbonate, and a molar ratio of the amount of ammonium perchlorate to an amount of lithium carbonate as the chlorine scavenger ($Li_2CO_3$) is about 2:1, the composition comprising a polymeric binder that is cellulose acetate butyrate in an amount up to 5% by weight of the total composition, and a catalyst that is red iron oxide in an amount up to 5% by weight of the total composition, the organic fuel is guanidine nitrate and an amount of oxygen required to convert carbon in the composition to carbon dioxide, hydrogen in the composition to water and surplus metal (metal remaining after all $Cl^-$ is scavenged) in the composition to the major oxide of the metal as an oxidizer to fuel ratio ranges between about 0.90 and 0.98.

8. The gas-generative composition of claim 6 wherein the chlorine scavenger is potassium nitrate and the molar ratio of the amount of ammonium perchlorate to the amount of chlorine scavenger is about 1:1.

9. The gas-generative composition of claim 6 wherein the chlorine scavenger is strontium nitrate and the molar ratio of the amount of ammonium perchlorate to the amount of chlorine scavenger is about 2:1.

10. The gas-generative composition of claim 7 wherein the chlorine scavenger is barium nitrate, and the molar ratio of the amount of ammonium perchlorate for the amount of claimed scavenger is about 2:1.

11. The gas-generative composition of claim 7 wherein the oxygen to fuel ratio is about 0.95.

12. The composition of claim 1 in the form of a granular mix.

13. The composition of claim 1 in the form of a pressed charge.

14. A method for inflating an inflatable device with a nontoxic, reduced particulate gas mixture, comprising the following steps:

1) providing an enclosed pressure chamber having exit ports in communication with the inflatable device;

2) placing within said pressure chamber the gas-generative composition of claim 1 and a compressed inert gas; and 3) igniting said gas-generative composition upon detection by a sensor of the pressure chamber being subjected to a sudden deceleration characteristic of a crash or an autoignition charge to produce said nontoxic reduced particulate gas mixture of combustion products and the inert gas, whereby said gas mixture is substantially instantly generated and conducted through the exit ports of said pressure chamber to an inflatable device.

15. The method of claim 14 comprising the step of providing an occupant restraint device as the inflatable device.

16. The method according to claim 14 wherein the gas-generative composition is in the form a granular mix.

17. The method according to claim 14 wherein the gas-generative composition is in the form of a pressed charge.

18. A gas generator comprising a gas-generative composition within a pressure vessel and an igniter device for igniting the gas-generative composition to generate a gas for inflating an inflatable component, the improvement comprising utilizing the gas-generative composition of claim 1 as the gas-generative composition of the gas generator.

19. The gas-generative composition of claim 8 comprising a polymeric binder that is cellulose acetate butyrate in an amount up to 5% by weight of the total composition, and a catalyst that is red iron oxide in an amount up to 5% by weight of the total composition, the organic fuel is guanidine nitrate and an amount of oxygen required to convert carbon in the composition to carbon dioxide, hydrogen in the composition to water and surplus metal (metal remaining after all $Cl^-$ is scavenged) in the composition to the major oxide of the metal as an oxidizer to fuel ratio ranges between about 0.90 and 0.98.

20. The gas-generative composition of claim 9 comprising a polymeric binder that is cellulose acetate butyrate in an amount up to 5% by weight of the total composition, and a catalyst that is red iron oxide in an amount up to 5% by weight of the total composition, the organic fuel is guanidine nitrate and an amount of oxygen required to convert carbon in the composition to carbon dioxide, hydrogen in the composition to water and surplus metal (metal remaining after all $Cl^-$ is scavenged) in the composition to the major oxide of the metal as an oxidizer to fuel ratio ranges between about 0.90 and 0.98.

21. The gas-generative composition of claim 10 comprising a polymeric binder that is cellulose acetate butyrate in an amount up to 5% by weight of the total composition, and a catalyst that is red iron oxide in an amount up to 5% by weight of the total composition, the organic fuel is guanidine nitrate and an amount of oxygen required to convert carbon in the composition to carbon dioxide, hydrogen in the composition to water and surplus metal (metal remaining after all $Cl^-$ is scavenged) in the composition to the major oxide of the metal as an oxidizer to fuel ratio ranges between about 0.90 and 0.98.

* * * * *